United States Patent [19]

Parker

[11] 4,054,510

[45] Oct. 18, 1977

[54] SELECTIVE CONVERSION OF NORMAL PARAFFINS

[75] Inventor: Paul Thomas Parker, Baton Rouge, La.

[73] Assignee: Exxon Research and Engineering Company, Linden, N.J.

[21] Appl. No.: 741,906

[22] Filed: June 13, 1958

[51] Int. Cl.[2] ..... C10G 11/04

[52] U.S. Cl. ..... 208/120; 260/676 MS; 260/683 R

[58] Field of Search ..... 260/676 MS, 683.3; 208/120, 676 MS, 683 R

[56] References Cited

U.S. PATENT DOCUMENTS 2,971,903 2/1961 Kimberlin et al. ..... 208/119

OTHER PUBLICATIONS

Thesis of James B. Ifft, "Molecular Sieves; Behavior and Separation of Certain Organic Compounds and Mixtures" June 1957, pp. 33–38.

*Primary Examiner*—Herbert Levine
*Attorney, Agent, or Firm*—Roy J. Ott

[57] ABSTRACT

Normal paraffins are selectively adsorbed and cracked to olefins by contact with a 5 A crystalline alumino-silicate. The normal paraffins are thus removed from a mixture thereof with other hydrocarbons.

26 Claims, 3 Drawing Figures

EFFECT OF CONTACTING TEMPERATURE UPON POUR POINT REDUCTION

SELECTIVE CONVERSION OF NORMAL PARAFFINS

The present invention relates to the upgrading of hydrocarbon oils and more particularly relates to an improved process for eliminating normal paraffin hydrocarbons from oils in which they are present in admixture with other hydrocarbons which comprises contacting such oils with a metallic alumino-silicate having uniform pore spaces of about 5 Angstrom units under conditions such that normal paraffins are continuously adsorbed into the alumino-silicate and continuously converted to olefins which are recovered with the non-adsorbed constituents of the oil.

The invention in a preferred embodiment is a process for lowering the pour point of a middle distillate, boiling between 300° and 650° F., by treating it in the vapor phase with a 5A alumino-silicate at a temperature between 800° and 900° F. and at a space velocity of 0.3 to 1.2 lb./lb., removing any by-product boiling below 300° F. and recondensing the vaporized product.

Because of their low octane value in gasolines and their adverse effect upon the pour point and cloud point of hydrocarbon oils generally, normal paraffins are undesirable in high octane gasolines, aviation turbo-jet fuels, kerosines, heating oils, lubricating oils and other premium quality petroleum products. Recognition of this fact has spurred efforts to develop processes which will permit the removal of normal paraffins from oils intended for use in the manufacture of such products. One of the most promising methods proposed for separating normal paraffins from branched chain and cyclic compounds developed to date involves the use of adsorbents which are selective for the normal paraffin molecules. These adsorbents, generally referred to as molecular sieves, are crystalline metallic alumino-silicates containing a large number of submicroscopic cavities interconnected by many smaller pores or channels which are extremely uniform in size. Molecules having affinity for the alumino-silicate and small enough to enter the pores or channels are readily adsorbed, while those of greater size or lacking such affinity are rejected. By employing alumino-silicates having uniform pore spaces of about 5 Angstrom units in diameter, excellent separations between normal paraffins and other hydrocarbons present in hydrocarbon oils can be made.

The scientific and patent literature contains numerous references to the composition and adsorbing action of metallic alumino-silicates. In general these are crystalline zeolites containing an alkali or alkaline earth metal, aluminum, silicon and oxygen. They may be either natural or synthetic in origin and may have uniform pore spaces of from about 3 to about 15 Angstrom units, depending upon their composition and the conditions under which they were formed. As mentioned above, those having pores of about 5 Angstroms are useful for separating normal paraffins from branched chain and cyclic compounds. Among the natural zeolites having molecular sieve properties may be mentioned analcite, $NaAlSi_2O_6.H_2O$, and chabasite, $CaAl_2Si_4O_{12}.6H_2O$. Synthetic zeolites having similar properties are described in U.S. Pat. No. 2,306,610, where a material of the formula $(CaNa_2)\ Al_2Si_4O_{12}.2H_2O$ is set forth, and in U.S. Pat. No. 2,522,426, which discloses a composition having the formula $4CaO.Al_2O_3.4SiO_2$. Other molecular sieves are described in articles by Breck and others which were published in the Journal of the American Chemical Society, Volume 78, page 593 et seq. in December 1956.

Despite the excellent selective adsorption properties of molecular sieves, certain difficulties have been encountered in attempting to apply them to the large scale removal of normal paraffin hydrocarbons from branched chain and cylic hydrocarbons. In using such adsorbents, it is necessary to employ a two-step cyclic process. The normal paraffins must first be selectively adsorbed upon the molecular sieve. Usually this is accomplished by contacting the oil with the adsorbent at temperatures in the range of from about 100° to about 600° F. and at pressures of from about atmospheric to about 100 psig. Following this adsorption step, the molecular sieve must next be reactivated by a desorption step before it can be used for adsorption again. The desorption step is usually carried out by steaming the used adsorbent, evacuating it, or displacing the adsorbed compounds by means of a gas which is not itself adsorbed by the sieve. The capacity of molecular sieve adsorbents when used in this manner is very low and therefore such cyclic processes are relatively expensive because of the frequency with which the sieve must be desorbed. The desorption methods available are only partially effective and the selectivity and capacity of the sieve rapidly decline as it is used. A further difficulty is that carbonaceous deposits rapidly build up on the surface of the sieve. Regeneration of the sieve at frequent intervals by heating it to very high temperatures or by employing other regenerative techniques alleviates this latter difficulty to some extent but very frequent regeneration shortens the active life of the sieve. Because of these difficulties, the cost of effecting separations between hydrocarbons by means of molecular sieves is inordinately high.

The present invention provides a new and improved method for eliminating normal paraffins from hydrocarbon oils by means of molecular sieves which is free from many of the disadvantages associated with molecular sieve processes employed in the past. The process differs from prior processes in that molecular sieves are employed to effect chemical conversion of the normal paraffins upon a selective basis, rather than merely a mechanical separation. It has been found that normal paraffins present in a hydrocarbon oil can be selectively converted to olefins by contacting the oil with a molecular sieve having pore diameters of about 5A under critical conditions. It is believed that the explanation for this selective conversion phenomenon lies in the fact that gas phase configurations are possible in the pores of molecular sieves. It is impossible for a normal paraffin molecule to rotate in the 5 Angstrom pores of a molecular sieve except on its longitudinal axis and therefore the rotations corresponding to the three main moments of inertia of the molecule become vibrations as the molecule is occluded in the sieve. This results in a high loss in energy of the molecule over an extremely short period of time. By providing the molecule with a sufficiently high initial energy, it is possible to use this energy loss to effect rupture of bonds in the molecule and convert the normal paraffins into lower molecular weight olefins before complete occlusion takes place. The olefins are not retained by the sieve but instead are recovered with the non-adsorbed isoparaffins and cyclic compounds in the oil.

Regardless of the theoretical explanation for the phenomenon which takes place, the process of the invention has numerous advantages over processes which have been proposed for the removal of normal paraffins from hydrocarbon oils by means of molecular sieves in the past. Since the normal paraffins which would otherwise be occluded by the sieve are continuously converted to olefins which are not retained on the sieve, the pores of the sieve remain relatively free of hydrocarbons. No desorption step is necessary and the difficulties encountered in desorbing the sieve in prior processes are thus avoided. Olefins formed in the process can readily be separated from saturated constituents in the oil and form a valuable by-product. The simplified procedure and equipment employed make the process considerably more attractive from an economic standpoint than processes utilized heretofore.

Molecular sieve adsorbents suitable for use in the process of the invention are available commercially and may be produced in a number of ways. One suitable process for preparing such adsorbents involves the mixing of sodium silicate, preferably sodium metasilicate, with sodium aluminate under carefully controlled conditions. The sodium silicate employed should be one having a ratio of soda to silica between about 0.8 to 1 and about 2 to 1. Water glass and other sodium silicate solutions having lower soda to silica ratios do not produce the selective adsorbent crystals unless they are subjected to extended heat soaking or crystallization periods. Sodium aluminate solutions having a ratio of soda to alumina in the range of from about 1 to 1 to about 3 to 1 may be employed. High soda to alumina ratios are preferred and soidum aluminate solutions having soda to alumina ratios of about 1.5 to 1 have been found to be eminently satisfactory. The amount of the sodium silicate and sodium aluminate solutions employed should be such that the ratio of silica to alumina in the final mixture ranges from about 0.8 to 1 to about 3 to 1 and preferably from about 1 to 1 to about 2 to 1.

These reactants are mixed in a manner to produce a precipitate having a uniform composition. A preferred method for combining them is to add the aluminate to the silicate at ambient temperatures using rapid and efficient agitation to produce a homogeneous mixture. The mixture is then heated to a temperature of from about 180° to about 215° F. and held at that temperature for a period of from about 0.5 to about 3 hours or longer. The crystals may be formed at lower temperatures but in that case longer reaction periods are required. At temperatures above about 250° F. a crystalline composition having the requisite uniform size pore openings is not obtained. During the crystallization step, the pH of the solution should be maintained on the alkaline side, at about 12 or higher. At lower pH levels, crystals having the desired properties are not as readily formed.

The crystals prepared as described above have pore diameters of about 4 Angstrom units. To convert these to crystals having 5 Angstrom pores, it is necessary to employ a base exchange reaction for the replacement of some of the sodium by calcium, magnesium, cobalt, nickel, iron or a similar metal. Magnesium, cobalt, nickel and iron have greater cracking activity than does calcium and therefore it will often be preferred to employ solutions of these metals for replacement purposes.

The base exchange reaction may be carried out by water washing the sodium alumino-silicate crystals and adding them to a solution containing the desired replacement ions. An aqueous solution of magnesium chloride of about 20% concentration, for example, may be used for preparation of the magnesium form of the 5 Angstrom sieve. After a contact time which may range from about 5 minutes to about an hour, the 5 Angstrom product is filtered from solution and washed free of the exchange liquid. About 50 to 75% of the sodium in the crystals is normally replaced during the base exchange reaction.

The crystals thus prepared are in a finely divided state and are usually pelleted with a suitable binder material before they are calcined in order to activate them. Any of a number of binder agents used in the manufacture of catalysts may be employed for this purpose. A binder consisting of bentonite, sodium silicate and water, for example, has been found satisfactory. In using this binder, the constituents should be mixed so that the product contains from about 5 to 10% bentonite, 5 to 15% sodium silicate and about 75 to 90% of the crystals on a dry basis and that the total mixture contains about 25 to 35% water. This mixture may then be extruded into pellets or otherwise shaped and subsequently dried and calcined. Calcination temperatures of from about 700° to about 900° F. or higher are satisfactory.

In carrying out the process of the invention, the feed stream is contacted with the molecular sieve adsorbent in vapor phase at a temperature of from about 800° to about 1000° F. At temperatures below about 800° F. little conversion takes place and therefore removal of normal paraffins from the oil is low. At temperatures above about 1000° F. considerable thermal cracking of isoparaffinic and cyclic constituents of the oil takes place and hence much of the selectivity of the process disappears. Contacting temperatures of from about 800° to 900° F. are most effective and a temperature of about 850° F. is particularly preferred.

The pressures employed in contacting the oil with the adsorbent may range from about 50 mm. of mercury to about 150 psi. Generally it is preferable to carry out the contacting step at about atmospheric pressure. The feed rate employed may range from about 0.1 to about 3 pounds of oil per pound of molecular sieve per hour. Preferred rates range between 0.1 and 1.0 pounds per pound per hour. Under these conditions, normal paraffins present in the oil will be selectively converted to lower boiling olefins which are not retained upon the sieve and instead are discharged with the product oil. These olefins may be readily separated from the oil and constitute a valuable by-product of the process.

Although the olefins formed by the selective conversion of normal paraffins in the process are not retained upon the sieve, deposits gradually build up on the sieve surface, probably due to polymerization of the olefins. Sulfur compounds, water and other contaminating materials present in the feed may also contribute to the gradual accumulation of such deposits. In order to remove these deposits and maintain the activity of the adsorbent at a high level, the sieve is regenerated at suitable intervals. Although steam and other regeneration procedures heretofore disclosed may be employed in this step of the process, it is normally preferred to regenerate the sieve by passing a stream of oxygen-containing gas through the sieve bed at high temperatures. In the presence of the oxygen, the deposits are burned from the surface of the sieve and the sieve activity is restored. The quantity of oxygen required for this burning step is small, since the total amount of foreign matter on the sieve is small, and therefore gas streams containing as little as 5% oxygen may be used. It is preferred, however, to employ air for this purpose. The air or other gas stream used in the regenerative step may be preheated to a temperature of from about 500° to 800° F. before contacting it with the sieve. The high temperature zone formed by combustion of the deposits upon the sieve surface proceeds through the adsorbent mass rapidly and exists at any one spot for only a brief instant. It has been found that the sieve crystals are not appreciably impaired by this regenerative treatment.

In order to further minimize deposit formation and reduce the frequency of regeneration, it is often advantageous to contact the feed stream with a guard bed of alumina, silica gel or a similar adsorbent prior to introducing it into the treating zone. Polar contaminants in the feed are removed by the guard bed and hence the formation of deposits within the treating zone is reduced. The guard bed may be regenerated by burning or other conventional techniques.

The oils adapted for treatment in accordance with the process of the invention may in general be defined as hydrocarbon oils boiling in the range between about 100° to about 750° F. and especially between 320° and 650° F. Such oils include naphthas, kerosine (boiling between 320° and 555° F.) and middle distillates and are widely used for the production of gasolines, jet fuels, diesel fuels, heating oils and similar products wherein the content of normal paraffins must be limited to control undesirable effects such as solidification in storage at low temperature. The process of the invention is particularly effective for removing wax and similar normal paraffinic constituents from middle distillate petroleum fuels in order to reduce their pour point, cloud point and haze point, and it is in this area that the process of the invention will find widest application.

The exact nature and objects of the invention may be more readily understood by referring to the following detailed description of a preferred embodiment of the process, to the examples set forth hereafter, and to the attached drawings in which.

Figure 1:
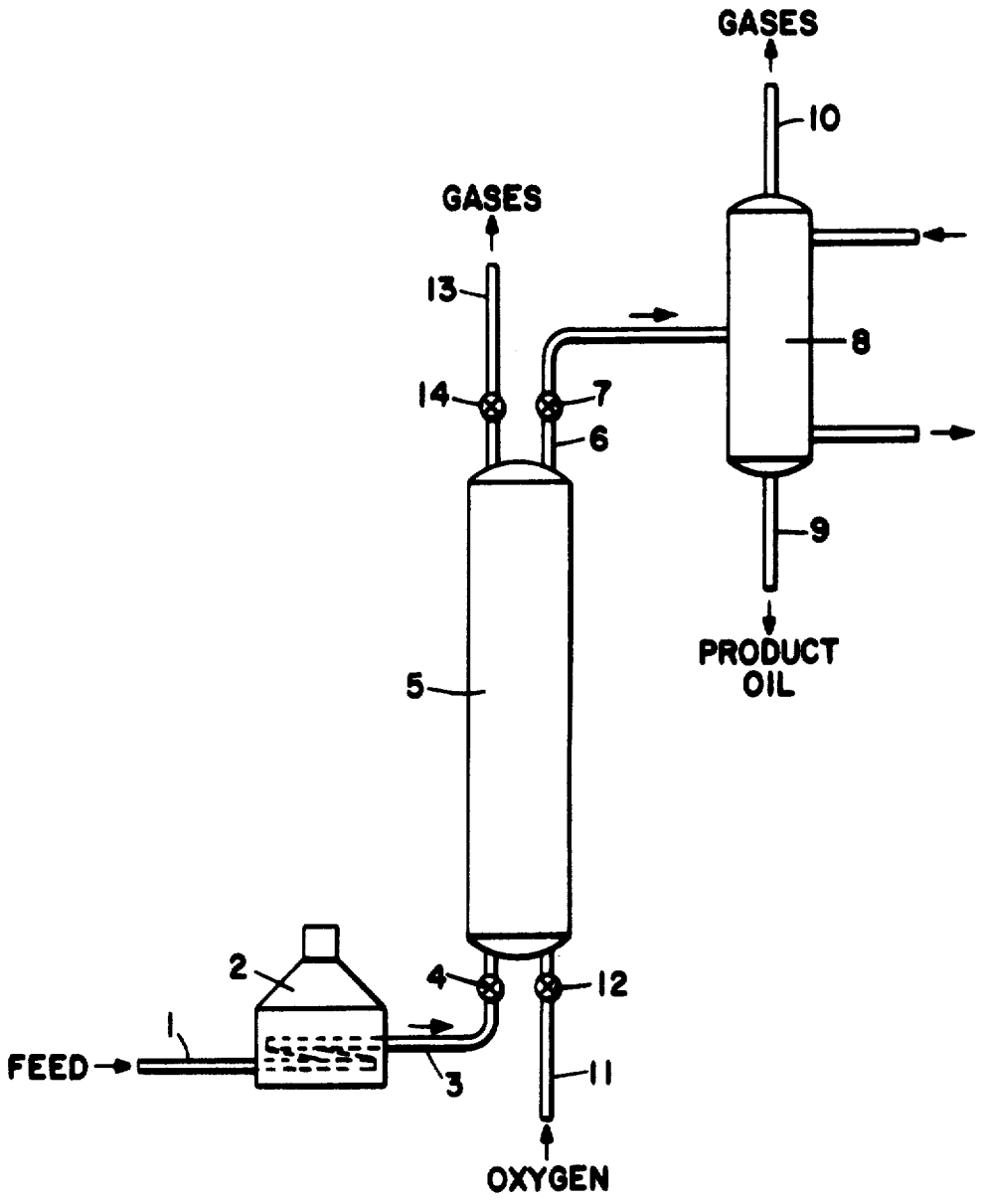
FIG. 1 depicts a flow diagram of a preferred embodiment of the process of the invention.

Referring now to FIG. 1 a hydrocarbon oil containing normal paraffins as well as iso-paraffinic and cyclic compounds, a gas oil boiling in the range of from about 450° to about 700° F., for example, is introduced through line 1 into furnace 2 where it is preheated to a temperature of about 850° F. The preheated feed, now in vapor phase, is passed through line 3 and valve 4 into contacting zone 5. The contacting zone has disposed therein a bed of molecular sieve having uniform pore diameters of 5 Angstrom units. The contacting zone may be fitted with suitable jacketing, heat coils or similar means for controlling temperature within the bed. The feed stream passes upwardly through the adsorbent bed and in so doing, normal paraffins present therein are selectively converted to lower molecular weight olefins. Some light gases are also formed. The vapor stream after contact with the adsorbent is removed overhead from contacting zone 5 through line 6 containing valve 7 and is passed to condenser 8. In the condenser, hydrocarbons boiling above about 100° F. are condensed and taken off as a bottoms product through line 9. Uncondensed gases are removed overhead through line 10. The product oil recovered through line 9 may be further fractionated to remove constituents boiling below the feed boiling point if desired. The overhead gas stream may be passed to a light ends plant for separation and recovery of the individual gaseous constituents.

The contacting procedure described above is continued until the concentration of normal paraffins in the product stream withdrawn through line 9 reaches an unacceptable level. This concentration may readily be determined by ultra violet analysis, infra red analysis, refractive index determination or the like. At this point sufficient deposits have formed upon the sieve surface to require regeneration of the sieve. Introduction of the feed stream is therefore halted and following nitrogen or other inert gas, air or other oxygen containing gas is introduced into the bottom of contacting zone 5 through line 11 containing valve 12. The gas stream should be preheated to a temperature of from about 500° to 800° F. This may be accomplished in a suitable furnace, not shown. Under the temperature conditions prevailing within the sieve bed, oxygen in the gas stream combines with the deposits on the sieve surface and the deposits are burned off. The combustion takes place within a narrow zone which moves from the bottom of the bed to the top of the bed. At any instant the temperature within the combustion zone may range from 1000° to 1500° F. but because of the short time during which these temperatures prevail at any level in the bed, crystallinity of the sieve is not materially affected. Gases are removed overhead from the contacting zone through line 13 containing valve 14. Upon completion of the regenerating step of the process, valves 12 and 14 closed and valves 4 and 7 opened to permit resumption of the contacting step. Although only one contacting vessel is shown in FIG. 1, it will be understood that in most cases it will be advantageous to employ two or more vessels suitably connected in parallel to permit regeneration of the spent sieve without interruption of the process. The arrangement of such vessels will be obvious to those skilled in the art.

The process of the invention is further illustrated by the following examples.

EXAMPLE 1

A petroleum middle distillate boiling between about 326° F. and about 680° F. was contacted with a calcium form molecular sieve having uniform pore diameters of 5 Angstrom units by passing the feed stream downflow through a fixed bed containing 500 grams of the sieve. The contacting temperature was 850° F. and the pressure was about 760 mm. of mercury. The feed rate averaged 1 pound of oil per pound of sieve per hour. This contacting was continued until about 750 grams of the oil had been passed through the sieve bed. At this point the operation was discontinued and the product collected was analyzed. A similar run was then made in which the feed stream was contacted with the sieve at a temperature of 390° F. and at a pressure of 0.2 mm. of mercury. Again the product recovered from the contacting zone was collected and analyzed. Inspections of the feed stream and the products from these two operations are shown in Table I below.

TABLE I

INSPECTIONS OF FEED AND PRODUCTS

| ASTM D-158 Distillation | Feed | 850° F. Product | 390° F. Product |
|---|---|---|---|
| I.B.P. | 326 | 108 | 328 |
| 5% | 369 | 180 | 362 |
| 10% | 385 | 320 | 378 |
| 20% | 415 | 352 | 406 |
| 30% | 440 | 418 | 430 |
| 40% | 472 | 456 | 456 |
| 50% | 504 | 502 | 488 |
| 60% | 533 | 534 | 520 |
| 70% | 562 | 560 | 552 |
| 80% | 592 | 579 | 584 |
| 90% | 623 | 592 | 620 |
| 95% | 642 | 598 | 654 |
| F.B.P. | 680 | 652 | 676 |
| Pour Point, ° F. | +5 | −55* | −40 |
| Cloud Point, ° F. | +16 | −55* | −32 |
| R.I. at 20° C. | 1.4630 | 1.4737* | 1.4662 |
| Bromine No. | 0.4 | 17.1 | 0.5 |

*850° F. product adjusted to 325° F. initial boiling point.

From the distillation data set forth in the above table it can be seen that an appreciable quantity of low boiling material was formed in the run carried out at 850° F., while essentially none was formed during the low temperature run. The initial 10% of the product collected in the 850° F. run had an extremely high bromine number, indicating that this fraction consisted largely of olefins. The pour point and cloud point data found in the table show that normal paraffins present in the feed stream were reduced to a much greater extent in the high temperature run than in the 390° F. run. This was true even after material boiling below 325° F. was removed from the 850° F. product. In the low temperature run it was found that the sieve bed rapidly became saturated with normal paraffins. In the high temperature run the sieve was inspected at the end of the run and there was no evidence of any hydrocarbons on the sieve. It therefore appears that normal paraffins present in the feed stream were adsorbed upon the sieve in both runs but that in the high temperature run the adsorbed compounds were continuously selectively converted to olefins which were not retained by the sieve.

EXAMPLE 2

A mixed blend gas oil boiling between 575° and 658° F. was passed through a bed containing 850 grams of a 5A calcium molecular sieve at temperatures of from 600° to about 1000° F. Data collected in these runs are shown in Table II below.

TABLE II

PRODUCT DISTRIBUTION AT SIEVE SATURATION[1]

| Contacting Temp. ° F. | 600 | 755 | 850 | 900 | 1010 |
|---|---|---|---|---|---|
| Pressure, mm Hg | — | — | 750 | — | — |
| Rate, W/W/Hr. | — | — | 0.5 | — | — |
| Feed Treated, g/100 g sieves | 83 | 80 | 195 | 190 | 190 |
| Total Product, g/100 g sieves | 70 | 70 | 170 | 158 | 118 |
| wt.% on feed | 84.0 | 87.0 | 85.7 | 83.4 | 61.9 |
| Material retained on sieve, g/100 g sieves | — | 7.3 | 7.8 | 7.6 | 10.6 |
| Product Distribution, wt.% on feed | | | | | |
| Gas ($C_4$ and lighter) | Nil | <0.5 | 5.4 | 6.1 | 15.6 |
| Naphtha ($C_5$-325° F.V.T.) | Nil | ≈1.0 | 1.9 | 6.3 | 7.3 |
| Product (325-575° F.V.T.) | Nil | 12.0 | 23.7 | 29.3 | 27.5 |
| (575° F.+ | 84.0 | 75.0 | 62.0 | 54.1 | 34.4 |
| Material retained on sieves | — | 9.1 | 4.0 | 4.0 | 5.6 |
| Material Balance | — | 97.6 | 97.0 | 99.8 | 90.4[2] |

[1]Sieves were considered saturated when products boiling above 575° F. showed no improvement in pour point compared to fresh feed.
[2]Poor material balance believed to be caused by loss of gas.

In order to differentiate between the benefits due to selective conversion of normal paraffins and benefits which might be due to cracking, only material boiling above 575° F. was considered in determining the saturation or exhaustion point. The data show that the amount of feed which can be treated before saturation occurs is considerably greater at temperatures of 850° F. and higher. A temperature of 850° F. showed the most favorable results. At that temperature the total product yield was about 86%, based on the feed. With increasing temperatures, this value decreased appreciably with a corresponding increase in the production of gases. This indicates that a non-selective cracking occurs when too high a temperature is used. Material retained on the sieve at a temperature of 1010° F. was greater than that retained at any of the lower temperatures. This again appeared due largely to non-selective cracking but may also be attributable to increased polymerization of olefins at the higher temperature.

EXAMPLE 3

The products obtained in the runs described in the previous example were analyzed and their inspections are set forth in Table III below.

TABLE III

PRODUCT INSPECTIONS

Mixed Blend Gas Oil Treated With 5A Molecular Sieves

| Contacting Temp. ° F. | — | 600 | 755 | 850 | 900 | 1010 |
|---|---|---|---|---|---|---|
| Liquid Product | | | | | | |
| Bromine No. | 2 | 4 | 6 | 6 | 7 | 11 |
| Mercaptan No. | 4.2 | 0.5 | 0.4 | Nil | 0.2 | 0.1 |
| Total S.Wt.% | 0.42 | 0.44 | 0.44 | 0.40 | 0.48 | 0.51 |
| Visc. 100° F.SUS | 47.6 | 47.0 | 45.2 | — | 46.0 | 41.2 |
| Aniline Pt. ° F. | 172 | | | 156 | | |
| R.I. at 68° F. | 1.4778 | 1.4813 | | 1.4855 | | |
| % Gas on Feed | — | Nil | <0.15 | 5.4 | 6.1 | 15.6 |
| Total Gas | | | | | | |
| Hydrogen, mol.% | | | | 21.7 | | 22.8 |
| Methane | | Essentially | | 11.3 | | 29.0 |
| Ethylene | | No Gas | | | 6.1 | 9.8 |
| Ethane | | Produced | | | 15.2 | 17.5 |

TABLE III-continued

| PRODUCT INSPECTIONS Mixed Blend Gas Oil Treated With 5A Molecular Sieves | | | | | | |
|---|---|---|---|---|---|---|
| Contacting Temp. ° F. | — | 600 | 755 | 850 | 900 | 1010 |
| Propylene | | | | | 22.1 | 15.7 |
| Propane | | | | | 14.4 | |
| Butene-1 | | | | | 2.5 | |
| Butene-2 | | | | | 2.9 | 5.2 |
| Isobutane | | | | | 1.5 | |
| n-butane | | | | | 2.3 | |
| Gas Gravity | | | | | 1.01 | 0.79 |

The inspections in the above table show that the bromine number of the product increased with increases in contacting temperature. The change in bromine number with a change in contacting temperature of from 755° to 900° F. was not appreciable. Increasing the temperature to 1010° F., however, brought about a large increase in bromine number. This indicates that at the lower temperatures, the process was largely limited to selective conversion of the normal paraffins and that at the higher temperature non-selective cracking was taking place.

EXAMPLE 4

Figure 2:
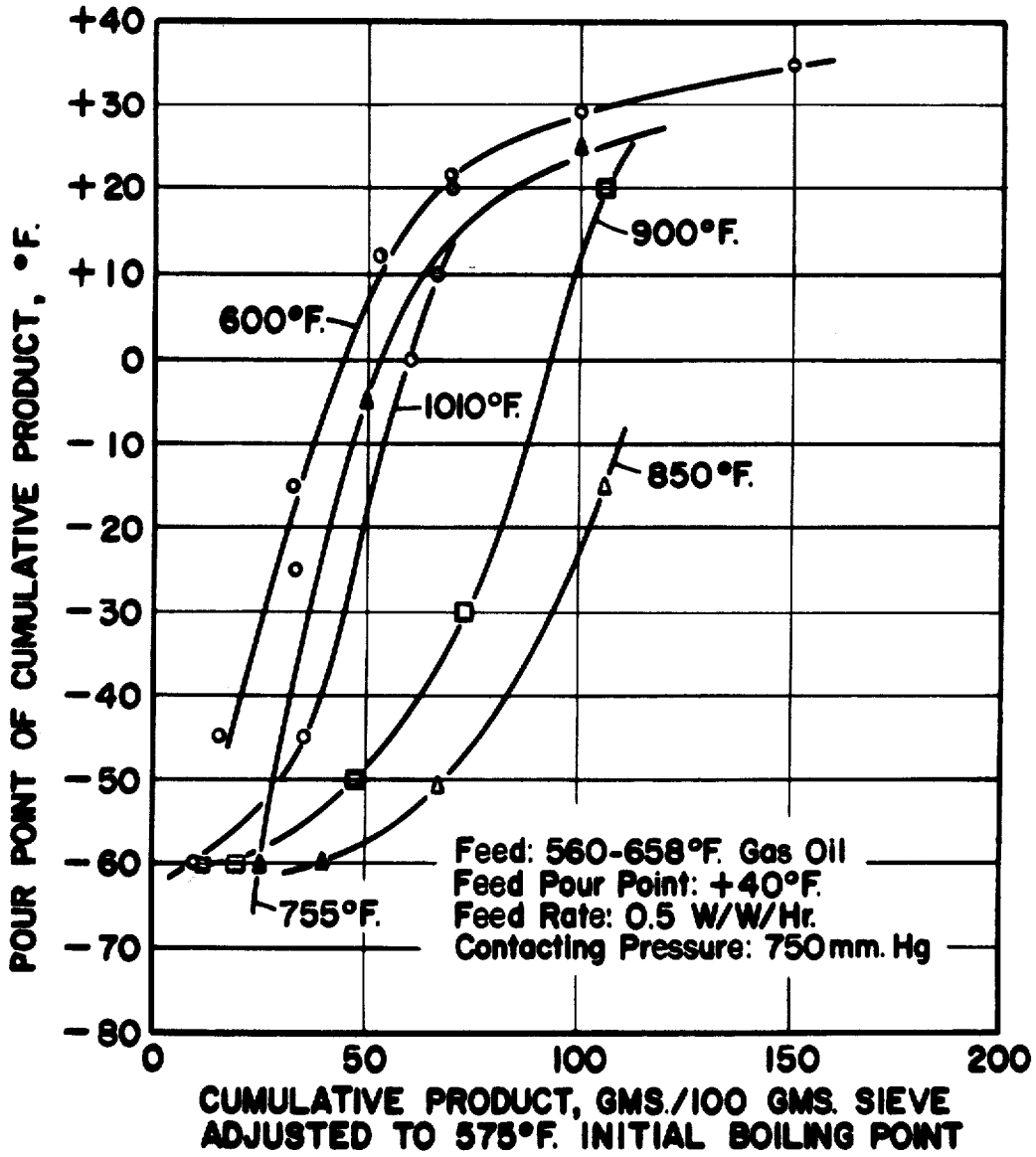
FIG. 2 is a graphical representation of data showing the effect of contacting temperature upon the reduction in pour point of a gas oil treated in accordance with the invention.

Samples of the product obtained at intervals during the runs described in Example 2 were tested to determine their pour points. These samples has been "flashed" to an initial boiling point of 575° F., approximately the initial boiling point of the feed, in order to avoid distortion of the results that would otherwise have been caused by the presence of the low boiling cracked materials, which naturally have low pour points. These pour point data are shown in FIG. 2 of the drawing. From the figure it can be seen that greater quantities of considerably lower pour point product can be obtained by contacting the feed at temperatures of 850° to 900° F. than can be obtained by treating the feed at higher or lower temperatures. At the lower temperatures the sieve rapidly becomes saturated and little further improvement in pour point results. At high temperatures above about 1000° F. non-selective cracking takes place and the pour point is not improved as much.

EXAMPLE 5

Figure 3:
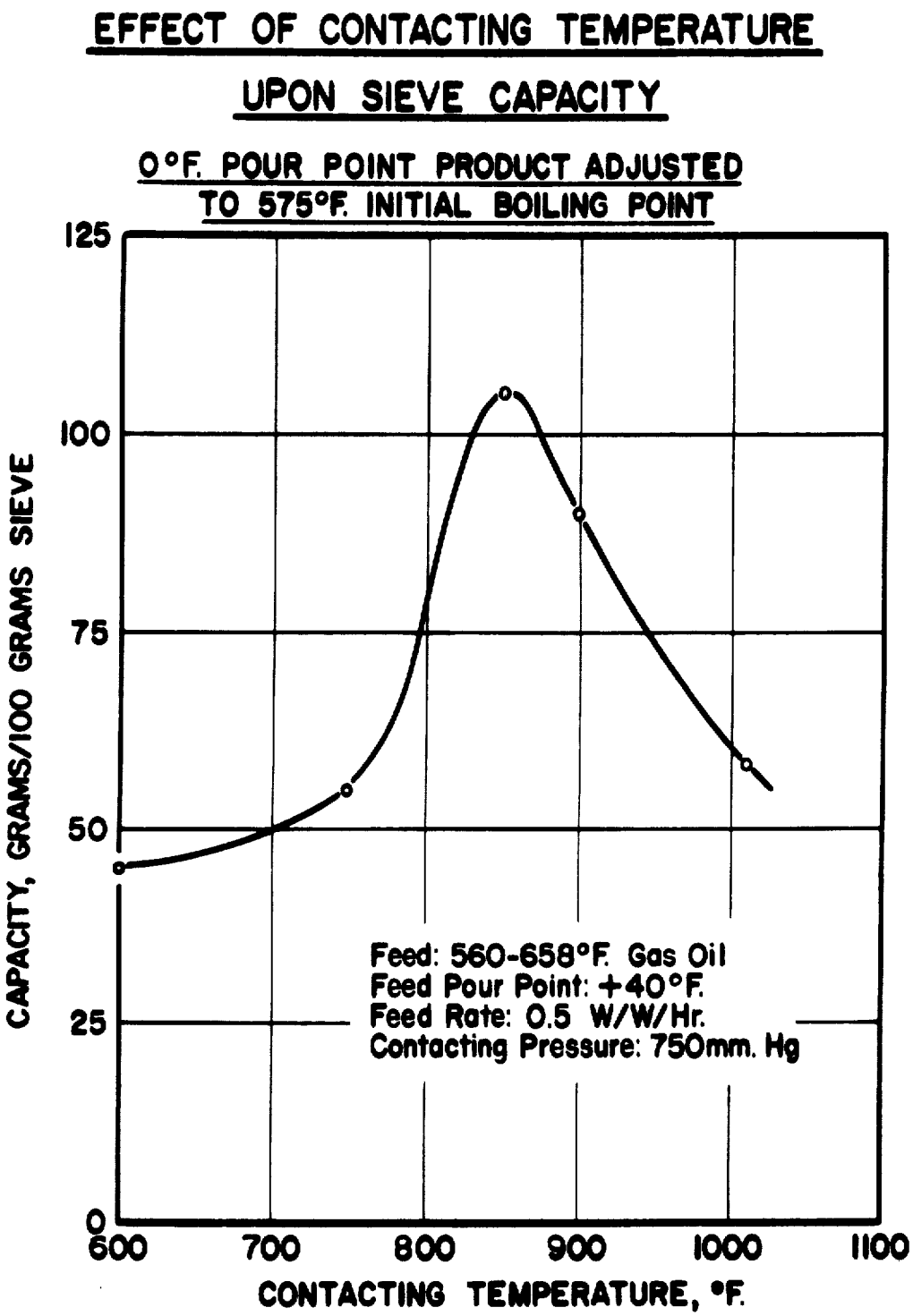
FIG. 3 is a graphical representation of data illustrating the effect of contacting temperature upon sieve capacity in the treatment of a gas oil in accordance with the invention.

Based on data obtained in the runs set forth in Example 2, sieve capacity at various temperatures for a 0° F. pour point product was determined. The results of these determinations are shown in FIG. 3. The data thus presented illustrate the critical effect of the contacting temperature upon sieve capacity. At a temperature of about 850° F. capacities in excess of 100 grams per 100 grams of sieve are obtained. At temperatures higher than 950° F., or lower than 800° F. capacity rapidly falls off.

EXAMPLE 6

In order to determine the effect of contacting pressure upon the selective conversion of normal paraffins, a gas oil was contacted with a 5A molecular sieve at a temperature of 980° F. and 750 mm. of mercury. A sample of the same gas oil was then tested under similar conditions except that the pressure was reduced to 200 mm. of mercury. It was found that the reduction in pressure improved the selective conversion of normal paraffins somewhat. This improvement, however, did not increase the yield of accumulative product in excess of that obtained at 850° F. and 750 mm. of mercury. Operation under the latter conditions is therefore to be preferred.

EXAMPLE 7

A number of runs were also conducted at a feed rate of 1.5 W/W/Hr. and the results obtained were compared with those obtained in earlier runs carried out at 0.5 W/W/Hr. It was found that increasing the feed rate from 0.5 to 1.5 W/W/Hr. without changing the temperature gave a lower yield of good product. By increasing the temperature to 950° F., however, it was possible to operate at the higher feed rate without any significant reduction in sieve capacity over that obtained at 850° F. with the lower feed rate.

EXAMPLE 8

In order to further demonstrate the effect of temperature and pressure upon the process of the invention, a $C_6$ naphtha was processed with a 5A molecular sieve at a temperature of 1100° F. and a pressure of 100 psig. The feed rate was 1 V/V/Hr. At this temperature and pressure it was found that a substantial amount of the naphtha was thermally cracked to form low boiling gases. Despite this thermal cracking, however, a considerable amount of selective conversion, nevertheless, took place as shown by the following data.

TABLE IV

| TREATMENT OF $C_6$ NAPHTHA 1100° F., 100 psig. | | |
|---|---|---|
| Liquid Product Components Vol. % | Feed | Product |
| n-Hexane | 52.3 | 36.1 |
| $C_6$ Isoparaffins | 30.4 | 30.3 |
| $C_6$ Naphthenes | 11.3 | 9.0 |
| Other type Hydrocarbons | 6.0 | 24.6 |
| Ratio n-Hexane to Isop. + Naphthenes | 1.25 | 0.92 |

From the above table it can be seen that the ratio of normal hexane to isoparaffins and naphthenes decreased from 1.25 to 0.92, indicating that normal paraffins were converted in the presence of the molecular sieve, in preference to isoparaffins and naphthenes. Under the conditions which have been found necessary for carrying out the process of the invention, thermal cracking does not occur to a significant extent and therefore the improvement in the ratio of straight chain compounds to isoparaffins and naphthenes would be considerably higher.

What is claimed is:

1. An improved process for selectively converting normal paraffins in a hydrocarbon oil to olefins which comprises contacting said oil in vapor phase at a temperature of from about 800° to 1000° F. with a crystalline metallic alumino-silicate having uniform pore spaces of about 5 Angstrom units in a contacting zone and withdrawing from said zone an oil having a reduced normal paraffins content and an increased olefins content.

2. A process as defined by claim 1 wherein said oil is contacted with said alumino-silicate at a pressure of from about 50 millimeters of mercury to about 50 psi.

3. A process as defined by claim 1 wherein said oil is contacted with said alumino-silicate at a rate of from about 0.1 to about 3.0 pounds of oil per pound of alumino-silicate per hour.

4. A process as defined by claim 1 wherein said oil boils in the range of from about 100° to about 750° F.

5. An improved process for selectively removing normal paraffins from a hydrocarbon oil boiling in the range between about 100° and about 750° F. which comprises vaporizing said oil, contacting the vapors at a temperature of from about 800° to about 1000° F. and a pressure of from about 50 mm. of mercury to about 50 psi. with a 5A molecular sieve in a contacting zone, withdrawing from said zone oil vapors containing olefins formed by the selective conversion of normal paraffins, continuing said contacting until the vapors withdrawn have an undesirably high normal paraffin content, and thereafter regenerating said molecular sieve.

6. A process as defined by claim 5 wherein said oil is contacted with said molecular sieve at a temperature of from about 850° to about 1000° F.

7. A process as defined by claim 5 wherein said oil is contacted with said molecular sieve at substantially atmospheric pressure.

8. A process as defined by claim 5 wherein said oil is contacted with said molecular sieve at a rate of from about 0.1 to about 1.0 lbs./lb./hr.

9. A process as defined by claim 5 wherein said molecular sieve is regenerated by contact with an oxygen-containing gas at elevated temperatures.

10. A process as defined in claim 1 wherein said oil is contacted with said alumino-silicate at a temperature in the range of about 850° to 1000° F.

11. A process for selectively cracking normal paraffins to olefins, which paraffins are contained in a hydrocarbon oil which comprises contacting the oil at a cracking temperature in the range of from 800°-1000° F. with a crystalline metallic alumino-silicate having a uniform pore size of about 5 Angstrom Units in a contacting zone and withdrawing from said zone an oil having a reduced normal paraffins content and an increased olefin content.

12. A process for selectively cracking normal paraffins to olefins which paraffins are contained in a hydrocarbon oil which comprises contacting the oil at a cracking temperature in the range of from 800° to 1100° F. with a crystalline metallic alumino-silicate having a uniform pore size of about 5A in a contacting zone and withdrawing from said zone an oil having a reduced normal paraffin content and an increased olefin content.

13. A hydrocarbon conversion process which comprises contacting a hydrocarbon fluid in a conversion zone at elevated temperatures, under conditions to effect a conversion of said hydrocarbon fluid, with a crystalline metallic aluminosilicate catalyst having uniform pore openings of about 5 Angstrom units, said material being the sole conversion catalyst in said zone and recovering a converted hydrocarbon product having a molecular weight no higher than said first-named hydrocarbon fluid.

14. The process of claim 13 wherein said catalyst comprises a member of the alkaline earth group.

15. A hydrocarbon conversion process which comprises contacting a hydrocarbon fluid in a conversion zone at an elevated temperature with a crystalline metallic aluminosilicate catalyst having uniform pore openings of about 5 Angstrom units, said catalyst having been prepared by base exchange of the sodium form of the crystalline aluminosilicate with a cation to substantially reduce its sodium content and, thus, improve its catalytic ability for carrying out said conversion, and recovering a converted hydrocarbon product having a molecular weight no higher than said first-named hydrocarbon fluid.

16. The process of claim 15 wherein higher molecular weight hydrocarbons are cracked into lower molecular weight hydrocarbons.

17. A hydrocarbon conversion process which comprises contacting a hydrocarbon fluid in a conversion zone at an elevated temperature with a crystalline aluminosilicate catalyst having uniform pore openings of about 5 Angstrom units, said aluminosilicate having the major portion of its cation content supplied by a cation other than sodium, and recovering a converted hydrocarbon product having a molecular weight no higher than said first-named hydrocarbon fluid.

18. The process of claim 17 wherein said cation other than sodium comprises an alkaline earth metal.

19. The process of claim 17 wherein said alkaline earth metal is calcium.

20. A hydrocarbon conversion process which comprises contacting a hydrocarbon fluid in a conversion zone at an elevated temperature with a crystalline aluminosilicate catalyst having uniform pore openings of about 5 Angstrom units, said aluminosilicate being substantially free of exchangeable sodium, and recovering a converted hydrocarbon product having a molecular weight no higher than said first-named hydrocarbon fluid.

21. A process for cracking a gas oil which comprises contacting said gas oil at a temperature of about 800° F. to 1,000° F. and at a pressure of about 0 psig. to 150 psi. with a crystalline metallic aluminosilicate catalyst having uniform pore openings of about 5 Angstrom units, said aluminosilicate having the major portion of its cation content supplied by a cation other than sodium.

22. The process of claim 21 wherein said aluminosilicate is substantially free of exchangeable sodium.

23. A hydrocarbon conversion process which comprises contacting a hydrocarbon fluid in a conversion zone at an elevated temperature with a catalyst consisting essentially of a crystalline metallic aluminosilicate having uniform pore openings of about 5 Angstrom units, said catalyst having been prepared by base exchange of the sodium form of the crystalline aluminosilicate with a cation selected from the group consisting of alkali metal and alkaline earth metal cations to substantially reduce its sodium content and, thus, improve its catalytic ability for carrying out said conversion, and recovering a converted hydrocarbon product having a molecular weight no higher than said first-named hydrocarbon fluid.

24. The process of claim 23 wherein higher molecular weight hydrocarbons are cracked into lower molecular weight hydrocarbons.

25. A process for cracking a gas oil which comprises contacting said gas oil at a temperature of about 800° F. to 1,000° F. and at a pressure of about 0 psig. to 150 psi. with a crystalline metallic aluminosilicate catalyst having uniform pore openings of about 5 Angstrom units, said aluminosilicate having the major portion of its cation content supplied by a cation, other than sodium selected from the group consisting of alkali and alkaline earth metal cations.

26. The process of claim 25 wherein said aluminosilicate is substantially free of exchangeable sodium.

* * * * *